United States Patent [19]

Berger

[11] 4,223,621

[45] Sep. 23, 1980

[54] MULTIHULL SAILING VESSEL HAVING MEANS FOR RIGHTING CAPSIZED VESSELS INCORPORATED THEREIN

[76] Inventor: Herman Berger, 27 Emerson Ave., Amityville, N.Y. 11701

[21] Appl. No.: 907,793

[22] Filed: May 19, 1978

[51] Int. Cl.[3] ..... B63B 1/00

[52] U.S. Cl. ..... 114/61; 114/39; 9/2 F

[58] Field of Search ..... 114/61, 39, 90; 9/2 R, 9/2 C, 2 F, 2 S

[56] References Cited

U.S. PATENT DOCUMENTS

| | | | |
|---|---|---|---|
| 3,016,859 | 1/1962 | Johnson | 114/39 |
| 3,395,664 | 8/1968 | Greenberg | 114/39 |
| 3,865,061 | 2/1975 | Newman | 114/61 |
| 3,937,166 | 2/1976 | Lindsay | 114/61 |
| 4,040,134 | 8/1977 | Downing | 114/61 |

OTHER PUBLICATIONS

Aqua-Cat Brochure-American Fibreglass Corp., Charleston, S. C.

*Primary Examiner*—Trygve M. Blix
*Assistant Examiner*—D. W. Keen
*Attorney, Agent, or Firm*—Stanley Ira Laughlin

[57] ABSTRACT

A multihull sailing vessel comprising a plurality of floats having ganged pivotal positioning means incorporated within transverse interconnecting members so that the floats may be rotated around longitudinal axes for righting the vessel whenever it is capsized.

8 Claims, 6 Drawing Figures

MULTIHULL SAILING VESSEL HAVING MEANS FOR RIGHTING CAPSIZED VESSELS INCORPORATED THEREIN

BACKGROUND OF THE INVENTION

The invention relates to multihull sailing vessels, and more particularly to catamarans, such as covered by Class 114; subclass 39.

Although the principle of multihulled boats, such as the catamaran and the trimaran, were known, having been used by the Polynesians for a long time, the prevailing opinion appears to be that the single hull sailing vessel is more stable. The common misconception is that the catamaran will more readily capsize, even though a study of boating accidents involving catamarans shows that the common misconception not absolutely correct. Applicant's invention is directed to incorporating within multihulls self-righting means so that the boating public will more readily explore the endless possibilities offered by catamarans and trimarans.

The prior art of the catamaran is fairly well covered in U.S. Pat. 3,370,560 to F. M. Lucht, whih describes a catamaran constructed to facilitate movement of the floats in either direction along their axes.

U.S. Pat. No. 3,860,982 to R. D. Rumsey describes a vehicular trailer which can be converted into a water craft by rotating pontoon floats from above the trailer to an operating position such that the wheels of the trailer are above the water.

It is an objective of Applicant's invention to provide safe, economical, and simple means for righting multihulled boats after they have capsized.

It is also an objective of Applicant's invention to provide fail-safe means for righting multi-hulled boats after capsizing.

SUMMARY OF THE INVENTION

The invention relates to multi-hulled boats and more particularly catamarans in which the floats can be positioned at various angles relative to their normal operating positions while the vessel is capsized in order to utilize the principles of buoyancy and altering the center of gravity to right the vessel.

BRIEF DESCRIPTION OF THE DRAWINGS

In order to more clearly point out Applicant's invention, reference is made to the following drawing, in which.

DETAILED DESCRIPTION

Figure 1:
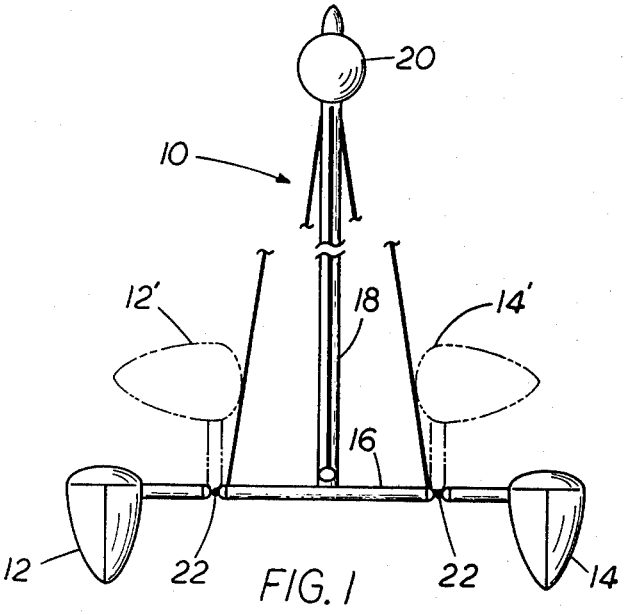
FIG. 1 is a front elevation view of a catamaran employing Applicant's invention.
Figure 2:
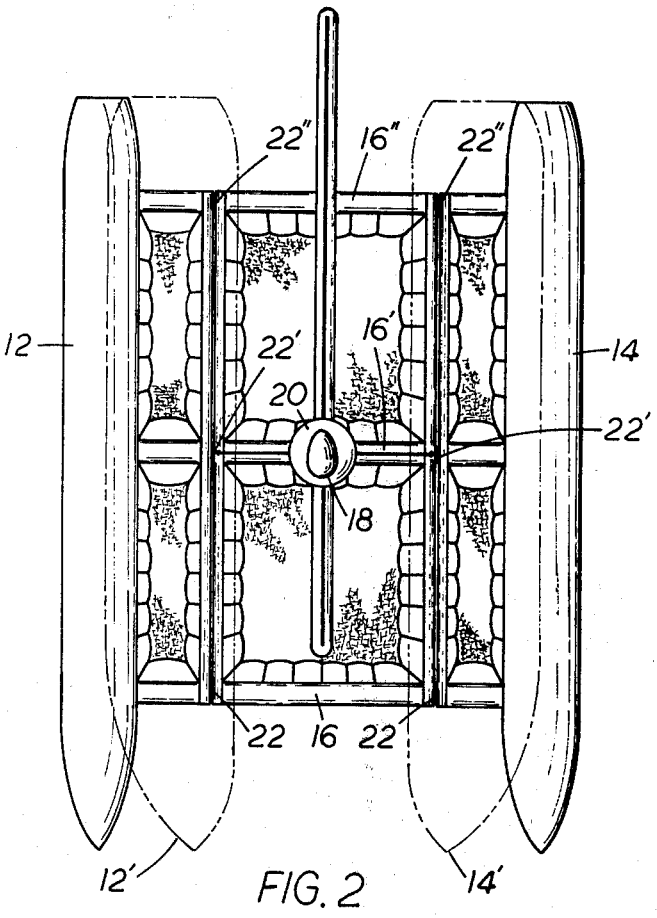
FIG. 2 is a plan or top view of the catamaran shown in FIG. 1.

FIGS. 1 & 2 show one embodiment of a catamaran generally indicated as 10 which basically comprises two narrow hulls or floats 12 & 14 held far enough apart by transverse structure 16, 16' & 16'' to hold up an efficiently large sail plan (not shown). Mast 18 employs a masthead float 20, which although shown as a "ballcock", any of the other types would work as well. It is noted that although a vessel employing a mast is illustrated, flotation means incorporated within any superstructure over the transverse interconnecting structure would function in the same fashion.

Pivotal means 22, 22' & 22'' for changing the position of floats 12 & 14 relative to center of gravity of the vessel as well as to each other comprises mechanical actuating means such as described in U.S. Pat. No. 3,860,982 ganged to be operated from a remote position, although only hinges are illustrated. The pivotal means 22, 22' & 22'' may be operated in discrete steps so as to provide some control over the righting of the vessel. The pivotal means 22, 22' & 22'' may be incorporated on or within the transverse structures 16, 16' & 16'' respectively. Although Applicant's embodiments show interconnecting transverse structure, Applicant's invention applies to any structure for interconnecting floats 12 & 14, such as combinations of webbing and rigid structure. Pivotal means 22, 22' & 22'' could also be employed in such other transverse structure. The outlined floats 12' & 14'' show alternateposition of floats 12 & 14.

Figure 3:
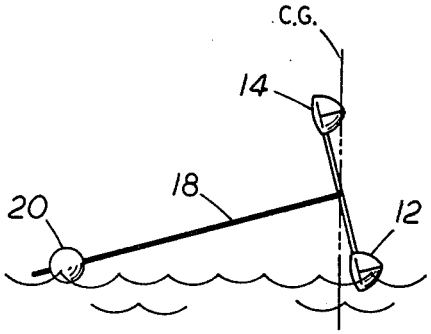
FIG. 3 is a simplified drawing of a capsized catamaran.
Figure 4:
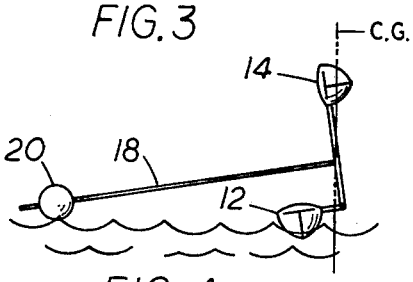
FIG. 4 is a simplified drawing of a catamaran being righted by Applicant's inventive improvements.
Figure 5:
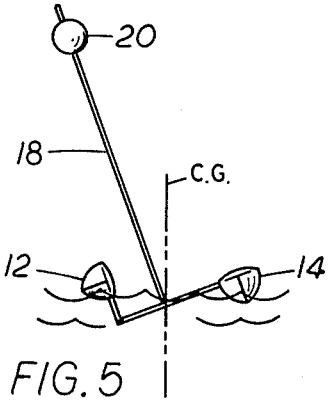
FIG. 5 is a simplified drawing of the catamaran more nearly righted than shown in FIG. 4.
Figure 6:
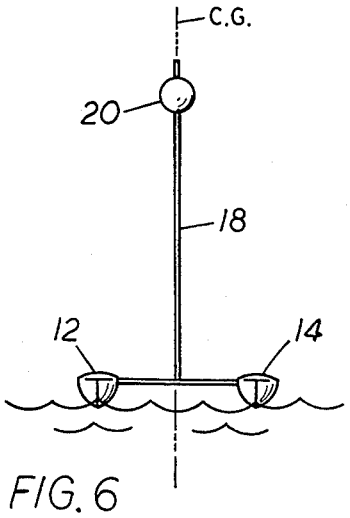
FIG. 6 is a simplified drawing of the catamaran shown in FIG. 1.

FIG. 3 illustrates a capsized catamaran, the ballcock flotation device 20 on the top of the mast preventing the vessel from completely overturning. FIG. 4 shows the employment of Applicant's invention by the movement of float 12 ninety degrees clockwise from its normal operating position. Movement of float 12 changes the center of gravity and therefore the buoyancy of the vessel so as to right the vessel; lifting the mast out of the water as shown in FIG. 5. Although not illustrated, float 14 may also be moved so as to further aid the righting of the capsized catamaran. When the vessel has been righted as shown in FIG. 5, float 12, and float 14 if moved, may be moved back to their normal operating positions, as shown in FIG. 6.

Obviously, had the catamaran capsized with float 14 floating on the water, movement of float 14 would be in the same manner as described above in the steps for moving float 12, except that movement would be in the counter-clockwise direction.

Although only one embodiment of Applicant's invention has been illustrated, Applicant's invention, applicable to all multihulled vessels, is not to be so limited, but is to be limited only by the breadth and scope of the annexed claims:

I claim:

1. A Multi-hull sailing vessel comprising a plurality of floats extending along their longitudinal axes, transverse structure interconnecting said floats, and flotational means positioned above said floats, said interconnecting transverse structure spacing apart said floats along said longitudinal axes and having pivotal means for positioning each of said floats around the longitudinal axes of the other floats by moving the float in the water towards the mast while keeping the float out of the water fixed so as to effect a change in the center of gravity of said vessel in a direction for righting said vessel when said vessel capsizes.

2. A multi-hull sailing vessel as claimed in claim 1 wherein said pivotal means comprises ganged mechanical actuating means

3. A multi-hull sailing vessel as claimed in claim 2 wherein said ganged mechanical actuating means comprises hinges.

4. A multi-hull sailing vessel as claimed in claim 3 wherein said hinges are operated by remote control means.

5. A multi-hull sailing vessel as claimed in claim 1 wherein said pivotal means position said floats in discrete steps.

6. A multi-hull sailing vessel as claimed in claim 1 wherein said plurality of floats comprise a pair of hulls.

7. A multi-hull sailing vessel as claimed in claim 1 wherein said flotational means positioned above said floats comprise a mast having flotational means incorporated therein.

8. A multi-hull sailing vessel as claimed in claim 1 wherein said flotational means positioned above said floats comprise a superstructure having flotational means incorporated therein.

* * * * *